US007849696B2

(12) United States Patent
De Sousa et al.

(10) Patent No.: US 7,849,696 B2
(45) Date of Patent: Dec. 14, 2010

(54) ASSEMBLING AN ANNULAR COMBUSTION CHAMBER OF A TURBOMACHINE

(75) Inventors: Mario Cesar De Sousa, Cesson (FR); Didier Hippolyte Hernandez, Quiers (FR); Laurent Pierre Elysee Gaston Marnas, Vaux le Penil (FR)

(73) Assignee: SNECMA, Paris (FR)

( * ) Notice: Subject to any disclaimer, the term of this patent is extended or adjusted under 35 U.S.C. 154(b) by 1226 days.

(21) Appl. No.: 11/447,109

(22) Filed: Jun. 6, 2006

(65) Prior Publication Data

US 2007/0107710 A1 May 17, 2007

(30) Foreign Application Priority Data

Jun. 14, 2005 (FR) ..... 05 05999

(51) Int. Cl.
*F02C 3/06* (2006.01)

(52) U.S. Cl. ..... 60/804; 60/753; 60/800

(58) Field of Classification Search ..... 60/752, 60/753, 796, 798, 799, 800, 804; 403/28; 411/82.5

See application file for complete search history.

(56) References Cited

U.S. PATENT DOCUMENTS 6,647,729 B2 * 11/2003 Calvez et al. ..... 60/753
6,655,148 B2 * 12/2003 Calvez et al. ..... 60/753
6,904,757 B2 * 6/2005 Mitchell et al. ..... 60/800
2005/0000228 A1 * 1/2005 De Sousa et al. ..... 60/796

FOREIGN PATENT DOCUMENTS

| | | | |
|---|---|---|---|
| EP | 1 265 031 | A1 | 12/2002 |
| EP | 1 265 033 | A1 | 12/2002 |
| EP | 1 431 665 | A2 | 6/2004 |
| EP | 1 479 975 | A1 | 11/2004 |

* cited by examiner

*Primary Examiner*—Louis Casaregola
(74) *Attorney, Agent, or Firm*—Oblon, Spivak, McClelland, Maier & Neustadt, L.L.P.

(57) ABSTRACT

An annular combustion chamber comprising axial walls interconnected by a chamber end wall having a coefficient of thermal expansion that is different from that of the axial walls, the chamber end wall being provided with a plurality of inner and outer fastener tabs secured by fastener systems to the end portions of the axial walls. Each fastener system comprises a bolt, a nut tightened onto one of the ends of the bolt, and a slideway bushing disposed around the bolt between the nut and the end portion of the corresponding axial wall, a determined amount of radial clearance being provided between the nut and the end portion of the axial wall so as to enable the chamber end wall to expand radially freely in operation relative to the axial walls.

10 Claims, 4 Drawing Sheets

ASSEMBLING AN ANNULAR COMBUSTION CHAMBER OF A TURBOMACHINE

BACKGROUND OF THE INVENTION

The present invention relates to the general field of combustion chambers for turbomachines. It relates more particularly to the problem posed by assembling an annular combustion chamber in which the axial walls and the end wall of the chamber are made out of materials having coefficients of thermal expansion that are different.

In the field of aviation, it is becoming more and more widespread to use high-temperature composite materials of the ceramic matrix composite (CMC) type instead of metals when making various components of a turbomachine, and in particular its combustion chamber. The use of a combustion chamber that is made entirely out of metal is completely unsuitable from a thermal point of view because of the very high temperatures of the combustion gases. This reduces the lifetime of the combustion chamber.

However, composite materials are very expensive and present relatively low strength when faced with high levels of mechanical stress. Thus, use of such materials is usually limited to the axial walls of the combustion chamber, while the radial wall (i.e. the end wall of the chamber) that unites these axial walls at their upstream ends continues to be made more conventionally out of metal.

Unfortunately, metals and composite materials present coefficients of thermal expansion that are very different. This leads to problems in the systems for assembling the combustion chamber between the axial walls that are made of composite material and the chamber end wall that is made of metal. In particular, the use of conventional bolt systems is no longer possible from the point of view of the mechanical strength of the walls.

In order to remedy that drawback, publication EP 1 479 975 discloses using fastener tabs that are secured to the chamber end wall and via which it is secured to the axial walls. Although that solution is advantageous, it nevertheless presents numerous disadvantages. In particular, such an assembly system does not make it possible to provide expansion that is sufficiently free, while also providing effective damping of the vibration to which the chamber end wall is subjected in operation. As a result, the fastener tabs are subjected in operation to very high levels of bending stress that are particularly harmful to the mechanical strength of the assembly, and in particular to the strength of the composite.

OBJECT AND SUMMARY OF THE INVENTION

The present invention thus seeks mainly to mitigate such drawbacks by proposing an assembly system making it possible in operation to achieve free expansion of the chamber end wall relative to the axial walls, while providing effective damping of the vibration to which the chamber end wall is subjected.

To this end, the invention provides an annular combustion chamber comprising outer and inner axial walls connected together at their upstream ends by a chamber end wall having a coefficient of thermal expansion different from that of said axial walls, said chamber end wall being provided with a plurality of inner and outer fastener tabs secured by respective fastener systems to upstream end portions of the inner and outer walls, each fastener system comprising a bolt passing through one of the fastener tabs and the upstream end of the corresponding axial wall, and a nut tightened onto one of the ends of the fastener bolt, wherein each fastener system further comprises a slideway bushing disposed around the fastener bolt between the nut and the end portion of the corresponding axial wall, a determined amount of radial clearance being provided between the nut and the end portion of the axial wall so as to allow the chamber end wall to expand freely in a radial direction relative to the axial walls.

The presence of fastener tabs that are flexible but prestressed, in combination with fastener systems presenting a determined amount of radial clearance between the nut and the axial wall, has the effect of simultaneously improving the damping of the vibration to which the combustion chamber is subjected, and of attenuating the effects of the expansion in operation of the chamber end wall relative to the axial walls. As a result, the fastener tabs are subjected in operation to small amounts of bending stress only.

In an advantageous disposition of the invention, each fastener tab includes a washer of metal with the corresponding slideway bushing and fastener bolt passing therethrough, the bushing being made of metal. Contact between the bushing and the fastener tab is of the metal-on-metal type. Such contact presents the advantage of leading to much less wear, and to repairs that are limited in cost compared with repairing a worn contact of ceramic-on-metal type.

In another advantageous disposition of the invention, contact between the washer of a fastener tab and the corresponding slideway bushing is substantially toroidal. This type of contact has the advantage of facilitating sliding between the bushing and the fastener tab, while avoiding the phenomenon of jamming.

In yet another advantageous disposition of the invention, the washer of each fastener tab presents greater thickness so as to increase the contact area between said washer and the corresponding slideway bushing. Contact forces are thus spread over a larger area, thereby reducing contact wear between the bushing and the fastener tab.

Preferably, each fastener tab presents the same assembly prestress so as to impart stiffness to the chamber end wall for dynamic stability, during an initial operation stage.

The fastener systems may include means for damping vibration during the radial expansion stage of the chamber end wall relative to the axial walls. Such means may comprise a coil or blade type spring disposed around the slideway bushing between the nut and the corresponding fastener tab.

Means for providing sealing can also be provided between the chamber end wall and the axial walls. These means may be composed of a circular gasket of the strip type mounted in an annular groove formed between the fastener tabs and the end portion of the corresponding axial wall and including a rim for bearing in toroidal manner against said end portion of the axial wall.

Advantageously, an inner cap and an outer cap made of composite material extend the respective axial walls upstream from their end portions, each fastener bolt also passing through an orifice formed in the corresponding cap.

The present invention also provides a system for fastening the chamber end wall to the inner and outer axial walls of an annular combustion chamber as defined above.

BRIEF DESCRIPTION OF THE DRAWINGS

Other characteristics and advantages of the present invention appear from the following description given with reference to the accompanying drawings which show an embodiment having no limiting character. In the figures.

DETAILED DESCRIPTION OF AN EMBODIMENT

Figure 1:
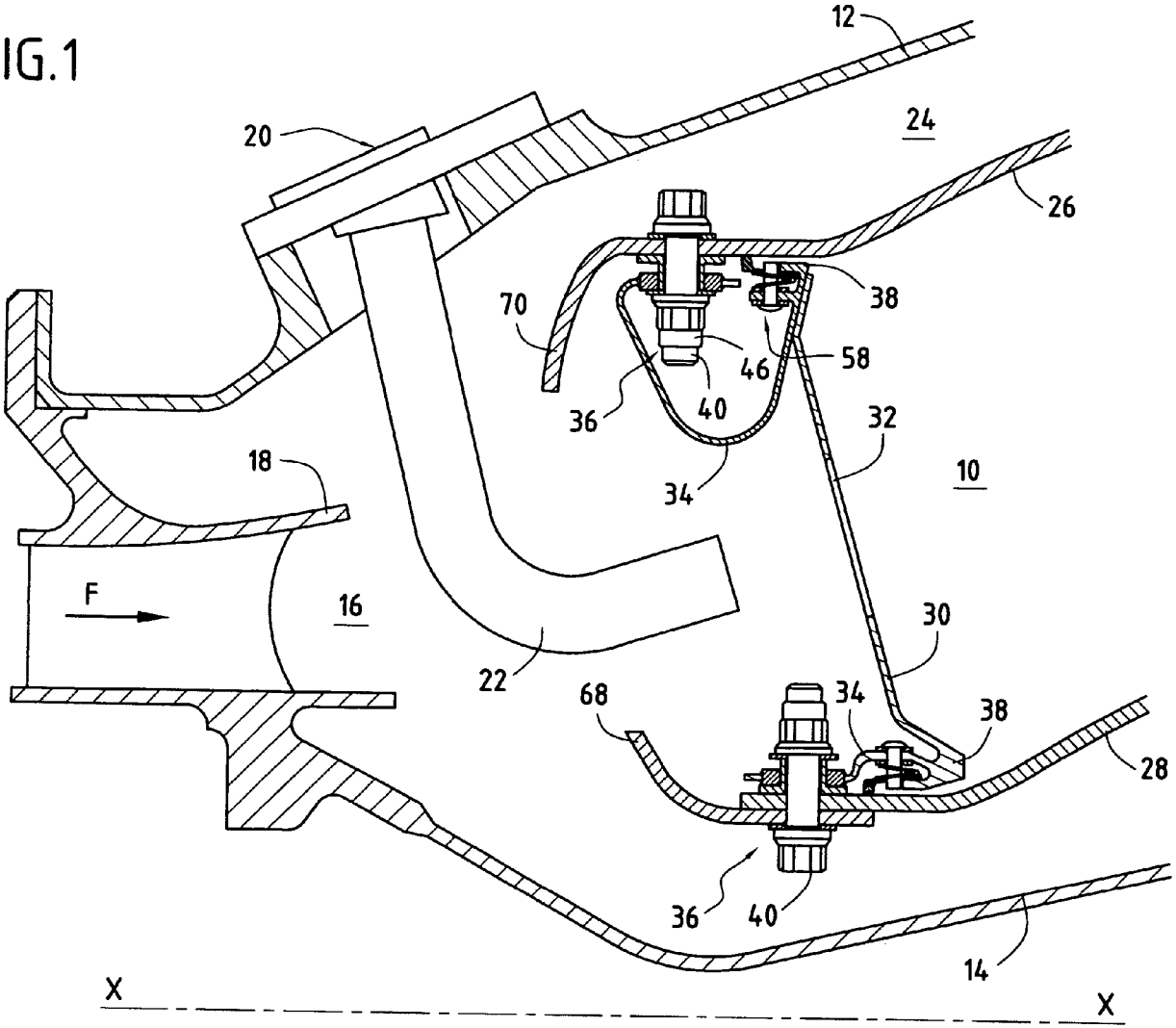
FIG. 1 is a fragmentary section view of a turbomachine combustion chamber of the invention.

FIG. 1 is a fragmentary axial section view of a turbomachine combustion chamber 10 in its environment.

An outer annular shroud (or outer casing) 12 and an inner annular shroud (or inner casing) 14 coaxial therewith are centered on the axis X-X of the turbomachine. An annular space 16 formed between these two shrouds receives compressed air in a general stream F coming from a compressor (not shown) of the turbomachine via an annular diffusion duct 18. This air is for combustion of the fuel in the chamber 10.

A plurality of injection systems 20 are distributed regularly around the diffusion duct 18 and open out into the annular space 16. Each of these injection systems is provided with a fuel injection nozzle 22 secured to the outer shroud 12. In order to simplify the drawings, the mixer and the deflector associated with each injection nozzle are omitted.

The combustion chamber 10 of the turbomachine is mounted inside the annular space 16 so as to leave respective annular channels 24 between itself and the outer and inner shrouds 12 and 14 for receiving a flow of dilution and cooling air. The chamber is of the annular type; it is constituted by an outer axial wall 26 and an inner axial wall 28 coaxial with the outer wall. These axial walls 26 and 28 are centered on the axis X-X of the turbomachine.

A transverse wall 30 forming a chamber end wall interconnects the upstream ends of the axial walls 26 and 28 of the combustion chamber. This chamber end wall 30 is provided with a plurality of openings 32 through which the fuel injection nozzles 22 pass.

The chamber end wall 30 and the axial walls 26 and 28 are made of materials having coefficients of thermal expansion that are very different. For example, the axial walls may be made of a high temperature ceramic material of the CMC type, or of some other type, while the chamber end wall may be made of a metal material.

Figure 2:
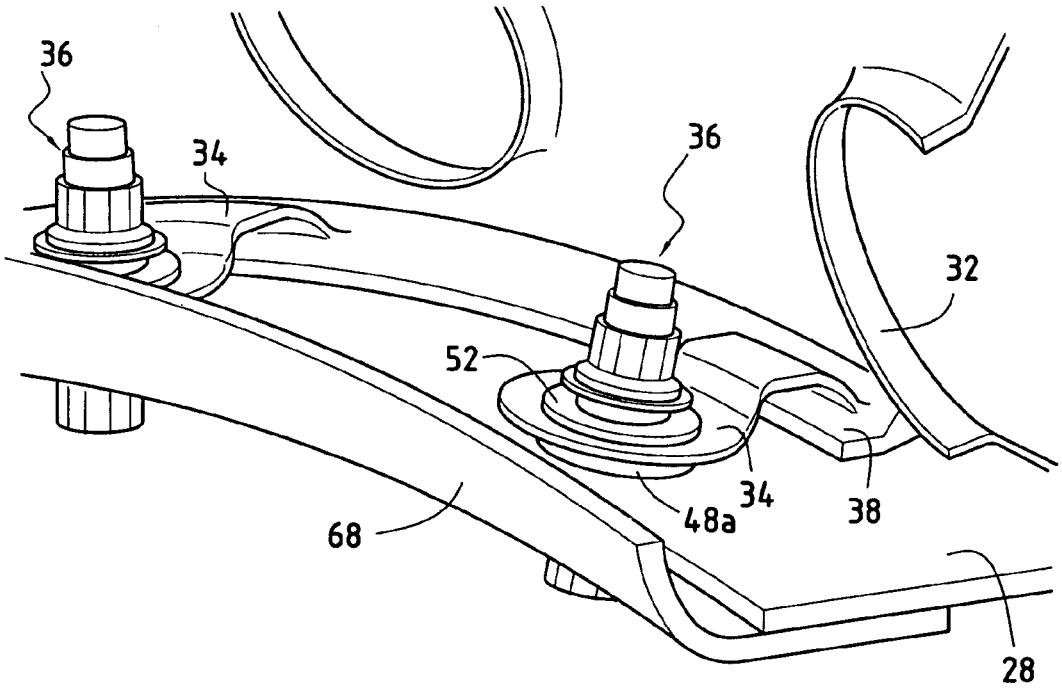
FIG. 2 is a fragmentary perspective view showing a fastener system for the FIG. 1 combustion chamber.

As shown in FIGS. 1 and 2, the chamber end wall 30 is provided at its ends with a plurality of inner and outer flexible fastener tabs 34, each secured to the upstream end portions of the axial walls 26, 28 by means of a respective bolt type fastener system 36.

The fastener tabs 34 are in the form of flexible tongues integrated in respective rings 38 secured to the chamber end wall 30, e.g. by welding. They extend upstream beyond the fastener system 36 and they are regularly distributed around the entire circumference of the combustion chamber.

Figure 3A:
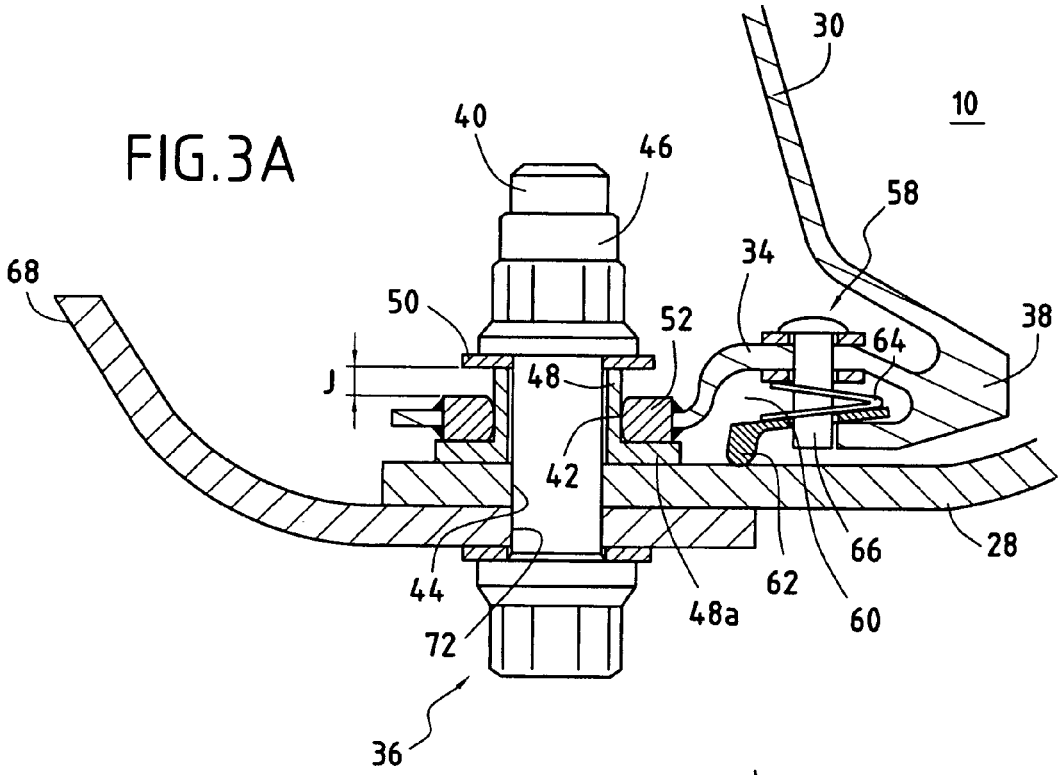
FIGS. 3A and 3B are section views showing a FIG. 2 fastener system while operating cold and hot.
Figure 3B:
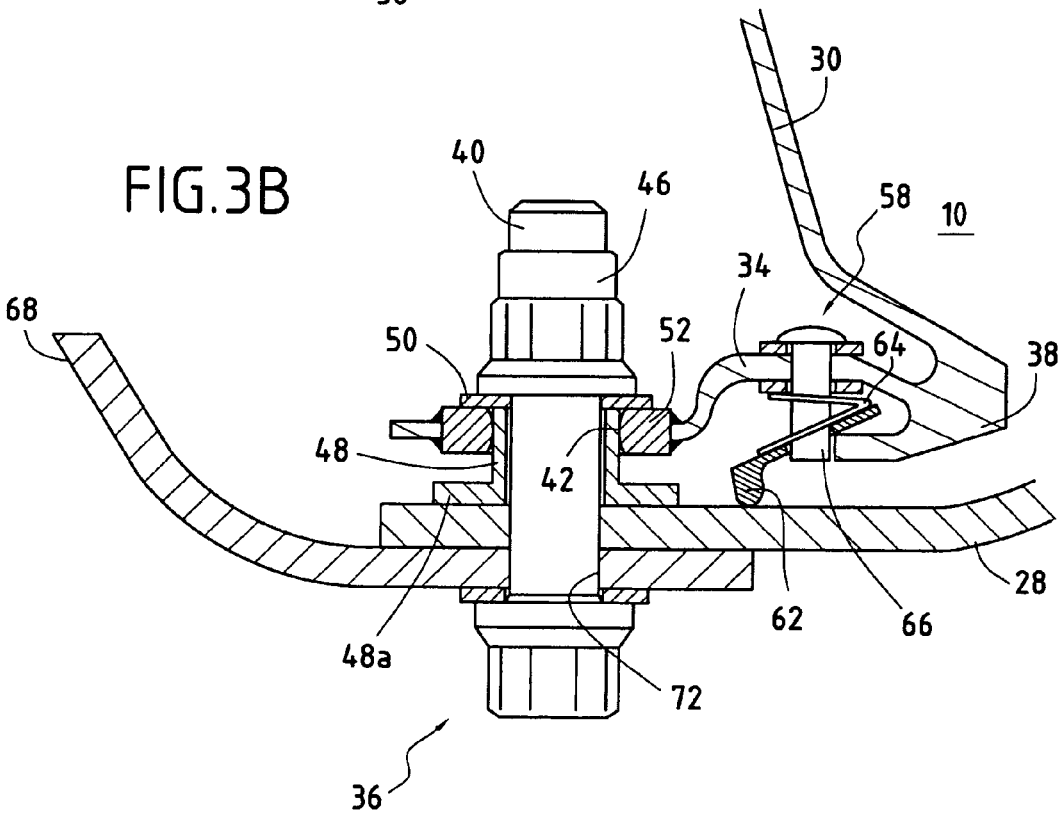

As shown in FIGS. 3A and 3B, each fastener system 36 comprises a fastener bolt 40 passing through orifices 42, 44 formed respectively in the corresponding fastener tab 34 and in the upstream end portion of the corresponding axial wall 26, 28. A nut 46 is tightened onto one of the ends of the fastener bolt 40.

In the invention, each fastener system 36 further. includes a slideway bushing 48 disposed around the fastener bolt 40 between the tightening nut 46 and the upstream end portion of the corresponding axial wall 26, 28 of the combustion chamber. Furthermore, determined radial clearance J is provided between the nut 46 and the upstream end portion of the axial wall 26, 28. Thus, the slideway bushing 48 presents radial height that is suitable for accommodating such clearance J.

At each fastener system 36 of the combustion chamber, the clearance J serves in operation to allow the chamber end wall 30 to expand freely in a radial direction relative to the axial walls 26, 28. Such expansion is made necessary by the fact that the chamber end wall 30 presents a coefficient of thermal expansion that is much greater than that of the axial walls 26, 28.

A bearing washer 50 may be interposed between the tightening nut 46 and the slideway bushing 48 such that the clearance J is provided between facing faces of such a bearing washer 50 and the corresponding fastener tab 34. The presence of a bearing washer 50 is nevertheless not essential, but serves to improve bearing contact in operation.

With such a configuration, each fastener tab 34 is suitable for sliding on the corresponding bushing 48 between a so-called "cold operation" position and a so-called "hot operation" position.

When assembling the combustion chamber, the fastener tabs 34 are mounted so as to be prestressed to bear against a shoulder 48*a* of the slideway bushing 48 so as to provide the chamber end wall with a certain amount of stiffness for dynamic stability. During the cold operation stage (FIG. 3A), i.e. the stage of operation during which the expansion difference between the chamber end wall 30 and the axial walls 26, 28 is not sufficient to overcome the assembly prestress of the fastener tabs 34, the tabs remain pressed against the shoulder 48*a*.

During the hot operation stage (FIG. 3B), i.e. the stage of operation in which the expansion difference between the chamber end wall 30 and the axial walls 26, 28 compensates the assembly prestress of the fastener tabs 34, each of the tabs slides radially along the corresponding bushing 48 so as to come into abutment against the bearing washer 50 (or against the tightening nut 46 if the washer is not present).

The clearance J and the assembly prestress of the assembly tabs 34 are thus dimensioned in such a manner as to allow the tabs to come into abutment against the shoulder 48*a* of the slideway bushing 48 and also against the bearing washer 50, depending on the operating stage of the turbomachine. The radial height of the clearance J is thus defined so as to obtain sufficient tension on the fastener tabs 34 to ensure that the chamber end wall 30 is vibrationally stable.

According to an advantageous characteristic of the invention, each fastener tab 34 has a washer 52 of metal material with the fastener bolt 40 and the corresponding slideway bushing 48 passing therethrough, the bushing likewise being made of metal. This characteristic makes it possible to achieve metal-on-metal contact between the bushing 48 and the fastener tab 34, thereby leading to wear that is much less than would be the case with ceramic-on-metal type contact.

Furthermore, the metal washer 52 is advantageously welded to the corresponding fastener tab 34 so as to make it easier to replace in the event of a high degree of wear.

According to another advantageous characteristic of the invention, contact between the metal washer 52 of each fastener tab 34 and the corresponding slideway bushing 34 is substantially toroidal. For this purpose, and as shown in FIGS. 3A and 3B, the orifice 42 formed by the metal washer 52 of the fastener tab 34 is substantially toroidal in shape. This characteristic has the advantage of facilitating sliding between the bushing 48 and the fastener tab 34 by limiting jamming phenomena.

According to yet another advantageous characteristic of the invention, the metal washer 52 of each fastener tab 34 presents greater thickness than the corresponding tab in order to increase the contact area between the washer and the corresponding slideway bushing 48, thereby reducing contact wear between these two elements.

It should be observed that the presence of the shoulder 48*a* on the slideway bushing 48 serves firstly also to spread out the contact forces between the bushing 48 and the fastener tab 34 (thereby reducing wear), and secondly to provide metal-on-metal contact with the metal washer 52 of the fastener tab.

Figure 4:
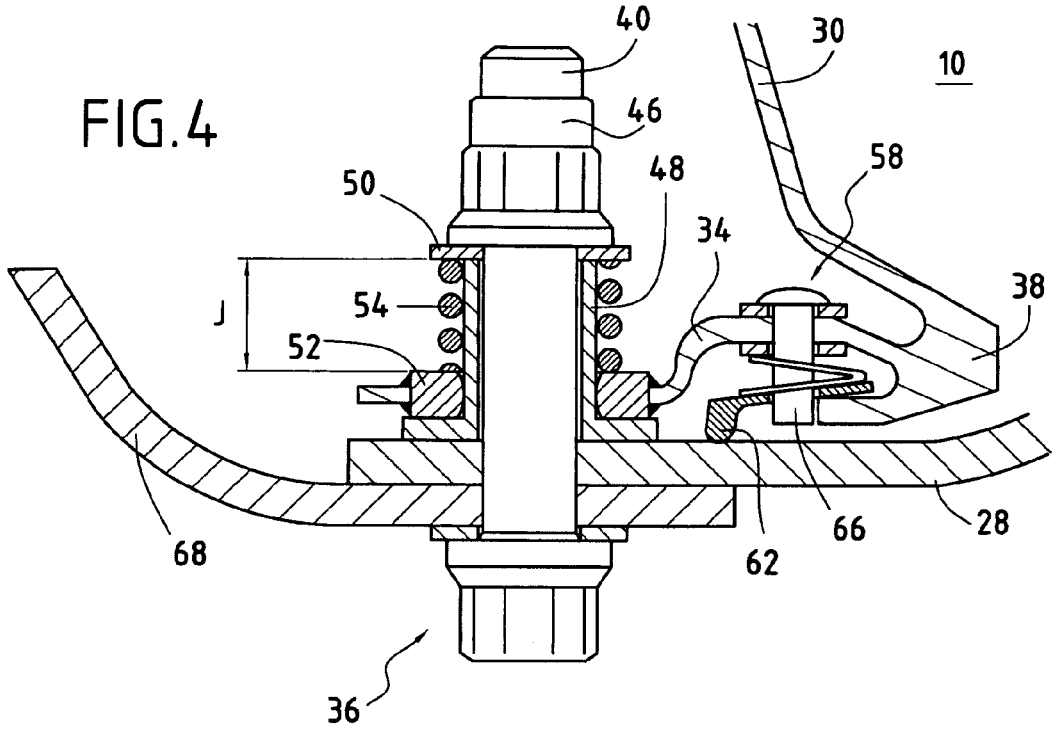
FIGS. 4 and 5 are section views of a FIG. 2 fastener system fitted with different damper means.
Figure 5:
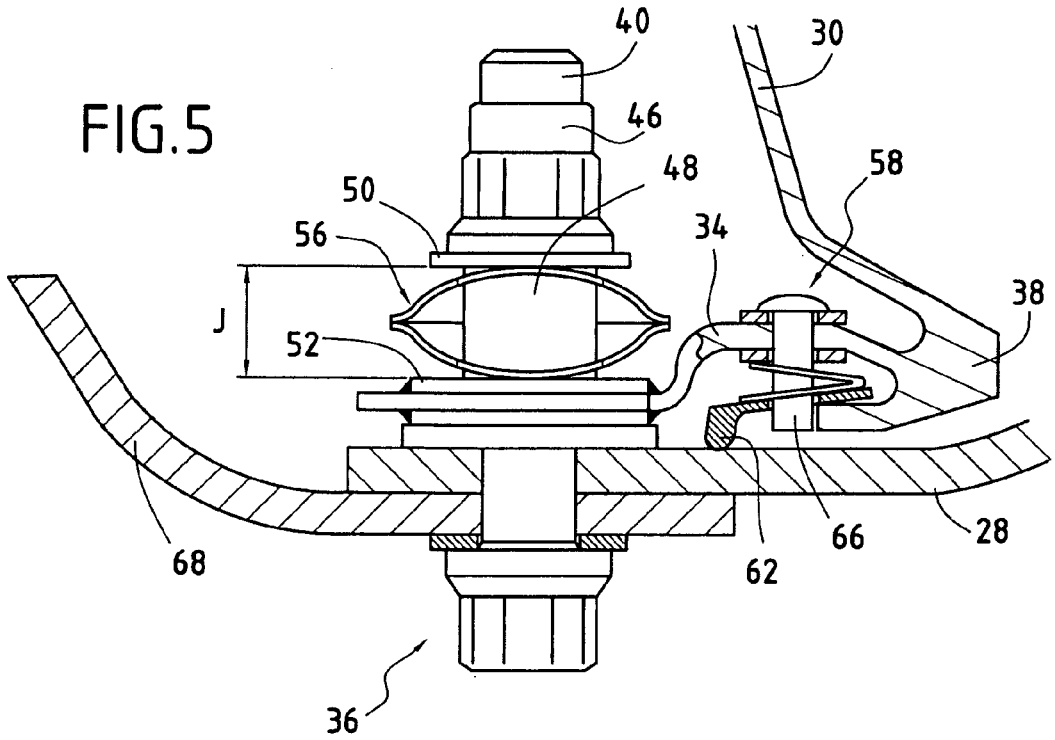

As shown in FIGS. 4 and 5, the fastener systems 36 may also include means for damping vibration during all the stages of operation of the engine by keeping radial expansion of the chamber end wall 30 "free" relative to the axial walls 26, 28.

In the embodiment of FIG. 4, these damper means comprise, for each fastener system 36, a coil spring 54 disposed around the slideway bushing 48 between the bearing washer 50 (or the tightening nut 46 if there is no washer) and the metal washer 52 of the corresponding fastener tab 34, i.e. occupying the radial clearance J.

In another embodiment as shown in FIG. 5, the damper means comprise, for each fastener system 36, a spring blade 56 likewise disposed round the slideway bushing 48 between the bearing washer 50 and the metal washer 52 of the corresponding fastener tab 34, i.e. occupying the radial clearance J.

Furthermore, there may be provided means for ensuring sealing between the chamber end wall 30 and the axial walls 26 and 28. As shown in the figures, for each fastener system 36, such means are in the form of a circular gasket 58 of the strip type mounted in an annular groove 60 formed between the fastener tab 34 and the upstream end portion of the corresponding axial wall 26, 28.

The sealing gasket 58 has a rim 62 for pressing in toroidal manner against the facing wall of the end portion of the axial wall 26, 28. The gasket is pressed against the wall by a resilient element 64 of the spring blade type, and it is held in position by a plurality of pegs 66 secured to the fastener tabs 34.

With such a configuration, the sealing gasket 58 is confined towards the chamber end wall 30 and therefore does not impede the flow of air in the annular channel 24.

The combustion chamber of the invention may also include an internal cap (or fairing) 68 and an external cap (or fairing) 70 made of the same material as the axial walls 26, 28 of the combustion chamber (i.e. in this case of composite material), and extending the respective end portions of the axial walls 26 and 28 upstream. Under such circumstances, each bolt 40 of the fastener systems 36 also passes through an orifice 72 formed in the corresponding cap 68, 70.

As shown in FIG. 1, the caps may either be directly integrated in the axial walls 26, 28 of the chamber (as is the case for the outer cap 70 of FIG. 1), or else they may be distinct therefrom (as is the case for the inner cap 68).

Associating fastener tabs with fastener systems having determined radial clearance in accordance with the invention presents numerous advantages. In particular, the fastener tabs, by their flexibility, serve to damp the vibration to which the combustion chamber is subjected, and the presence of radial clearance at the fastener systems enables the tabs to slide in operation, thereby greatly reducing the bending stresses to which they are subjected. The use of flexible fastener tabs with appropriate prestress on mounting thus serves to avoid degrading the integrity of the composite material forming the axial walls of the combustion chamber. Furthermore, the sliding contact between the bushing and the fastener tab takes place via metal parts, thereby limiting degradation. When wear does occur, these parts are also simpler to repair since all that is required to replace the metal washer of each fastener tab. Finally, compared with systems known in the prior art, the solution of the present invention provides a significant weight saving.

What is claimed is:

1. An annular combustion chamber comprising outer and inner axial walls connected together at their upstream ends by a chamber end wall having a coefficient of thermal expansion different from that of said axial walls, said chamber end wall being provided with a plurality of inner and outer fastener tabs secured by respective fastener systems to upstream end portions of the inner and outer walls, each fastener system comprising a bolt passing through one of the fastener tabs and the upstream end of the corresponding axial wall, and a nut tightened onto one of the ends of the fastener bolt, wherein each fastener system further comprises a slideway bushing disposed around the fastener bolt between the nut and the end portion of the corresponding axial wall, a determined amount of radial clearance being provided between the nut and the end portion of the axial wall so as to allow the chamber end wall to expand freely in a radial direction relative to the axial walls.

2. A combustion chamber according to claim 1, in which each fastener tab includes a washer of metal with the corresponding slideway bushing and fastener bolt passing therethrough, the bushing being made of metal.

3. A combustion chamber according to claim 2, in which the washer of a fastener tab is substantially toroidal.

4. A combustion chamber according to claim 2, in which the washer of each fastener tab presents greater thickness than the fastener tab so as to increase the contact area between said washer and the corresponding slideway bushing.

5. A combustion chamber according to claim 1, in which each fastener tab presents assembly prestress so as to impart stiffness to the chamber end wall for dynamic stability.

6. A combustion chamber according to claim 1, in which the fastener systems further include means for damping vibration of the chamber end wall relative to the axial walls.

7. A combustion chamber according to claim 6, in which the damper means are constituted by a coil or blade type spring placed around the slideway bushing between the nut and the corresponding fastener tab.

8. A combustion chamber according to claim 1, further including sealing means for sealing between the chamber end wall and the axial walls.

9. A combustion chamber according to claim 8, in which the sealing means comprise a circular gasket of the strip type mounted in an annular groove formed between the fastener tabs and the end portion of the corresponding axial wall and including a rim for bearing against said end portion of the axial wall.

10. A combustion chamber according to claim 1, further including an inner cap and an outer cap extending the respective axial walls upstream from their end portions, each fastener bolt also passing through an orifice formed in the corresponding cap.

* * * * *